US005533376A

United States Patent [19]

Wetzels et al.

[11] Patent Number: 5,533,376

[45] Date of Patent: Jul. 9, 1996

[54] METHOD FOR PREPARING A TUBULAR BLANK HAVING A THICK WALL FOR A FOLLOWING CASCADE DRAWING OPERATION

[75] Inventors: Walter Wetzels; Rainer Hergemoeller, both of Aachen, Germany

[73] Assignee: Schumag AG, Aachen, Germany

[21] Appl. No.: 293,053

[22] Filed: Aug. 19, 1994

[30] Foreign Application Priority Data

Aug. 20, 1993 [DE] Germany ..... 43 28 002.1

[51] Int. Cl.[6] ..... B21C 1/24

[52] U.S. Cl. ..... 72/283

[58] Field of Search ..... 72/283, 282, 278

[56] References Cited

U.S. PATENT DOCUMENTS

| | | | |
|---|---|---|---|
| 2,535,339 | 12/1950 | Woeller | 72/283 |
| 3,812,702 | 5/1974 | Benteler | 72/283 |

FOREIGN PATENT DOCUMENTS

| | | | |
|---|---|---|---|
| 0153495 | 8/1988 | European Pat. Off. . | |
| 0182922 | 1/1990 | European Pat. Off. . | |
| 0353324 | 6/1992 | European Pat. Off. . | |
| 8.822 | 5/1965 | Japan | 72/283 |
| 219418 | 9/1986 | Japan | 72/283 |
| 252834 | 11/1948 | Switzerland | 72/283 |
| 2007569 | 5/1979 | United Kingdom | 72/283 |

OTHER PUBLICATIONS

KRAFT- UND ARBEITSBEDARF BILDSAMER FORMGEBUNGSVERFAHREN by Arno Hensel et al., 12. Ziehen und Ziehwalzen (1 page) Nov. 1982.

*Primary Examiner*—Daniel C. Crane
*Attorney, Agent, or Firm*—W. G. Fasse; W. F. Fasse

[57] ABSTRACT

A tubular blank formed by casting or extrusion or the like and having a relatively thick wall is prepared for a following drawing operation, such as a tandem or cascade drawing, by widening one end of the tubular blank with a shackled mandrel. Then the widened or distended section is stretched by a cooperative, external stretching action between the shackled mandrel and a draw plate to form a stretched section. Then, the stretched section is passed through a draw plate that may be the same or a different draw plate than the first mentioned draw plate, and then drawing over the shackled mandrel to provide the required reduced wall thickness for the following tandem drawing.

17 Claims, 7 Drawing Sheets

FIG.1A
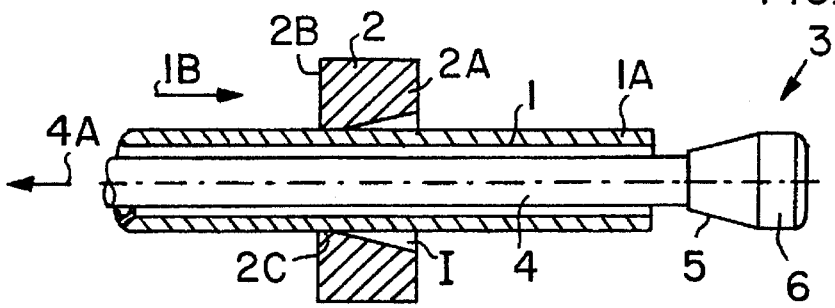
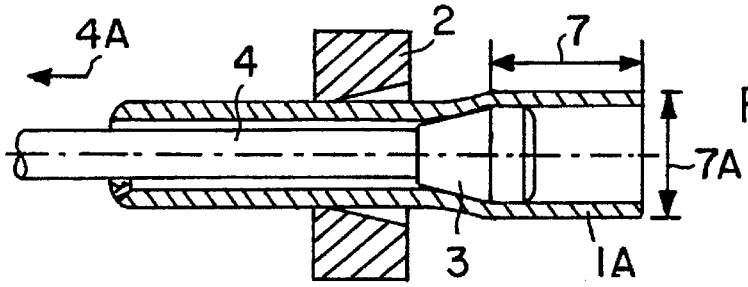
FIG.1B
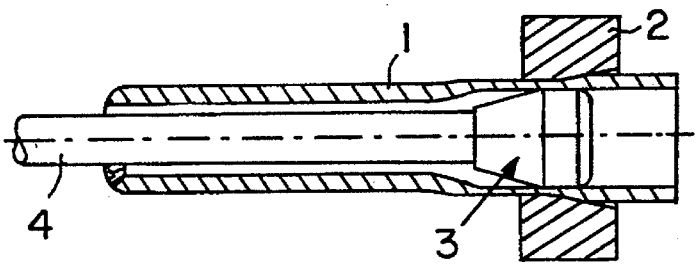
FIG.1C
FIG.1D
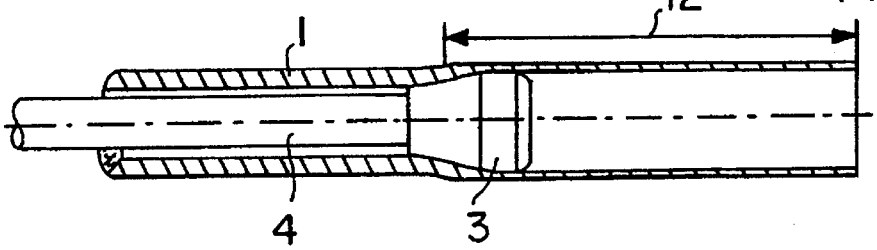
FIG.1E
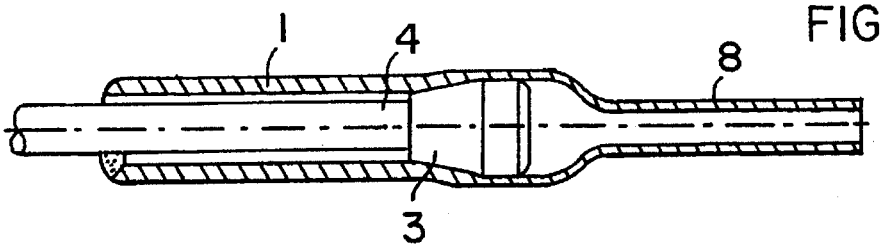

FIG.3A
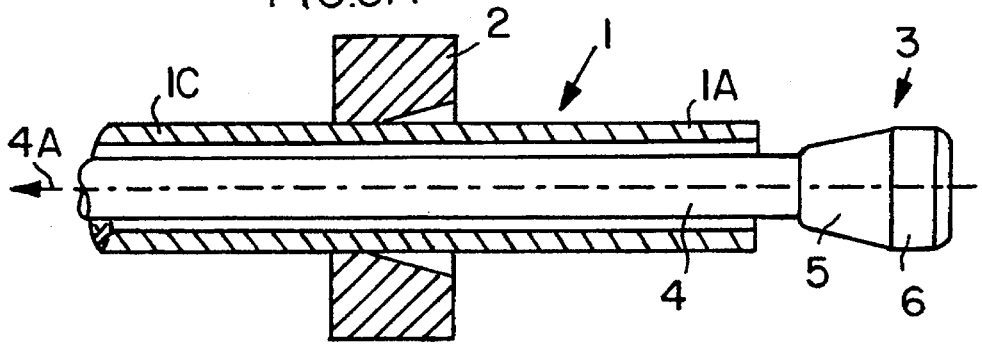
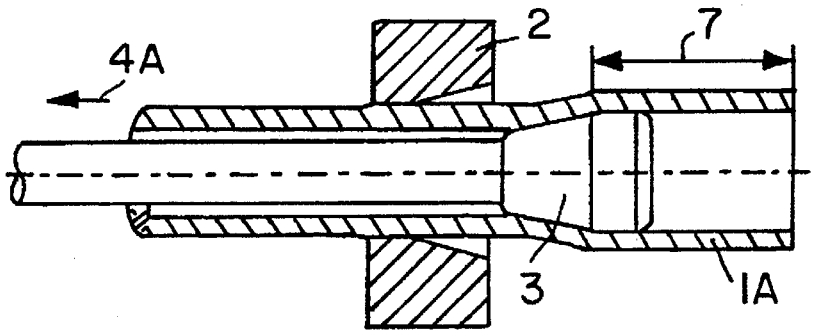
FIG.3B
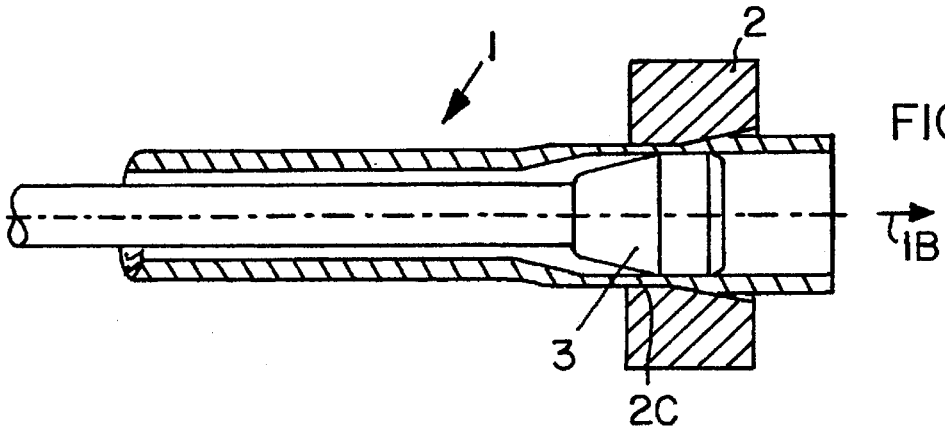
FIG.3C
FIG.3D
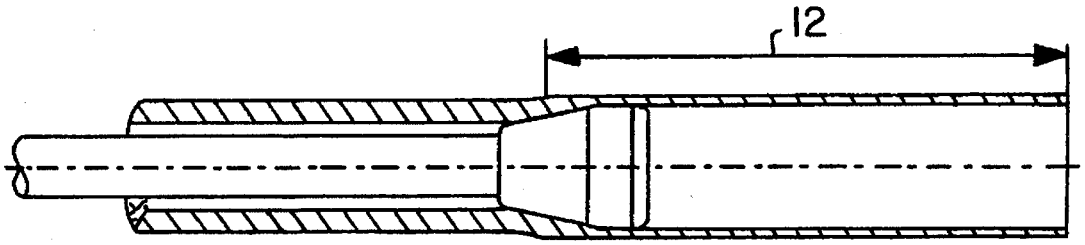

FIG.5A
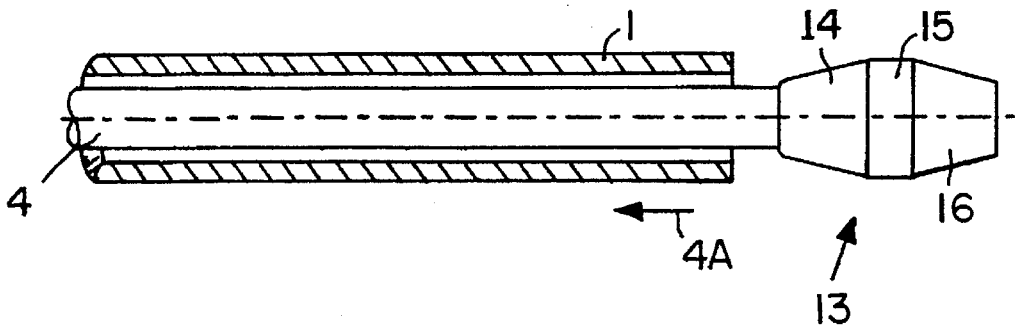
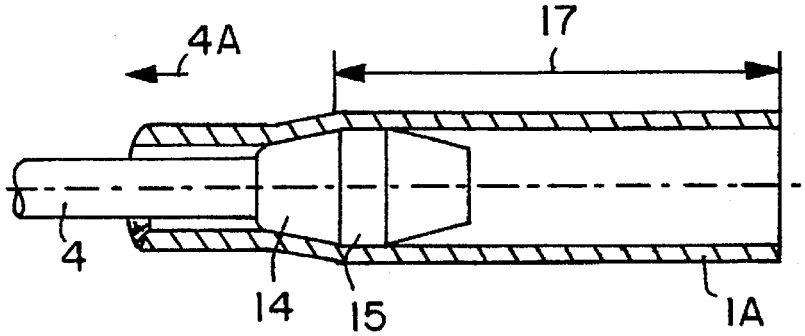
FIG.5B
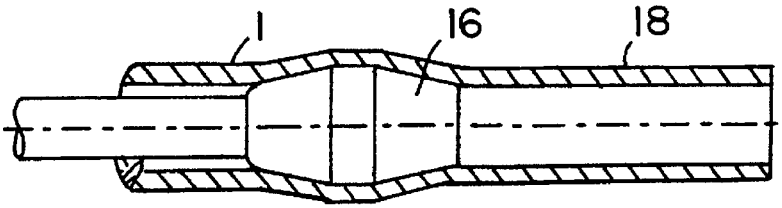
FIG.5C

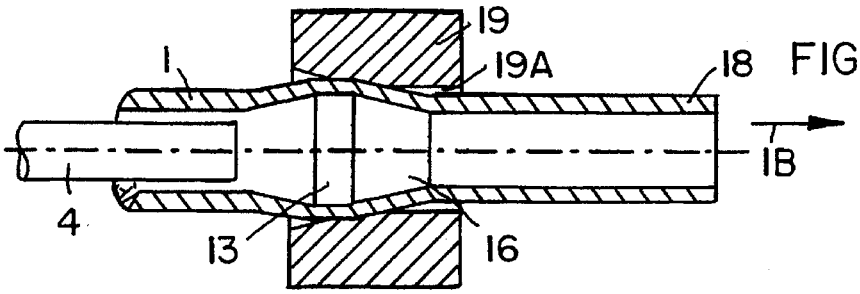
FIG.6A
FIG.6B
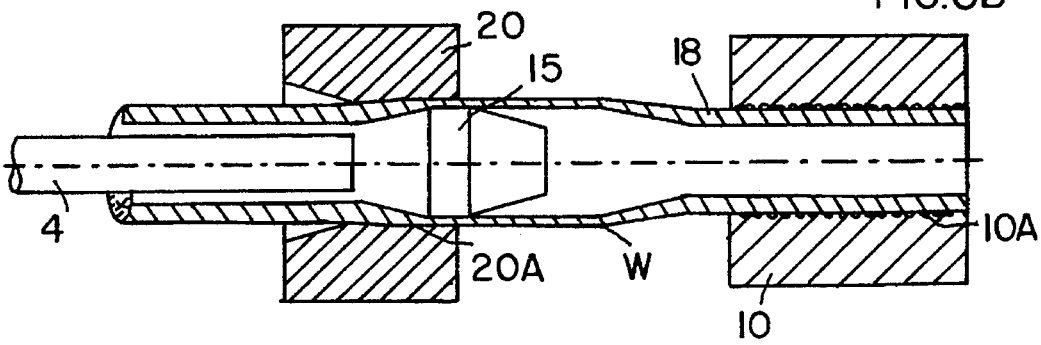
FIG.6C
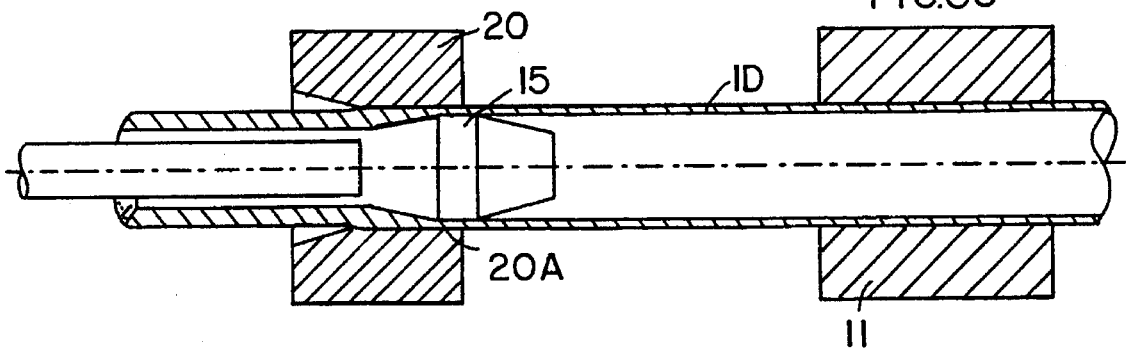

METHOD FOR PREPARING A TUBULAR BLANK HAVING A THICK WALL FOR A FOLLOWING CASCADE DRAWING OPERATION

FIELD OF THE INVENTION

The invention relates to a method for preparing tubular blanks which were produced by casting or extruding or the like with relatively thick walls, for a subsequent drawing, for example, by so-called cascading or tandem drawing that will be performed with the help of a so-called flying pin or mandrel subsequent to the preparation which provides a blank with the required small wall thickness.

BACKGROUND INFORMATION

Cascading or tandem drawing operations with the aid of a flying pin or mandrel are known in the art, for example, through European Patent Publications EP 0,182,922 B1 or EP 0,153,495 B1, or EP 0,353,324 B1. These prior art methods have proved themselves very well in practice and are particularly useful in their application to drawing pipes of copper or copper alloys. However, extruded or cast tubular blanks have a wall thickness that is too thick for a tandem type drawing operation as disclosed in the above European Patent Publications. Thus, conventionally, extruded or cast tubular blanks are, for example, first subjected to a cold pilgrim step operation in order to further reduce the initially extruded or cast wall thickness to make the blanks suitable for the subsequent tandem drawing. However, the cold pilgrim step method is technically involved and slow, particularly where it is necessary to achieve reduced wall thicknesses suitable for a following tandem drawing operation.

It is also known to increase the diameter of tubular blanks by drawing or rolling, whereby the blank wall thickness is necessarily reduced as a result of the diameter increase. Reference is made in this connection to a book entitled "Kraft und Arbeitsbedarf bildsamer Formgebungsverfahren" (Power and Work Requirement for Plastic Shaping Methods), 1st. Ed. VEB. Deutcher Verlag fuer Grundstoff Industrie, Leipzig, §12 "Drawing and Rolling". Such diameter increasing methods do not provide any hints toward the preparation of thick wall tubular blanks for a subsequent tandem drawing. Thus, there is room for improvement in the prior art.

OBJECTS OF THE INVENTION

In view of the above it is the aim of the invention to achieve the following objects singly or in combination:

- to provide a simple and quick method for preparing thick walled tubular blanks that have been pressed, extruded, or cast, for a subsequent cascade or tandem drawing operation;
- to produce an intermediate tubular blank that has an advantageous diameter to wall thickness ratio for the subsequent cascade or tandem drawing operation;
- to combine a distention with a stretching that achieves simultaneously a wall thickness reduction of the tubular blank; and
- to achieve the blank wall thickness suitable for the subsequent tandem drawing, with an optimally low effort and expense.

SUMMARY OF THE INVENTION

The invention achieves the above objects in that the thick walled tubular blank is first distended or widened at one end by a shackled mandrel, whereupon the widened or distended section is stretched by a cooperation of the shackled mandrel with a drawing plate for forming a stretched section. The stretched section is then inserted or passed through a draw plate which may be the same as the first mentioned draw plate or a different draw plate may be used, so that the stretched section protrudes out of the draw plate in the drawing direction. Then the blank is drawn through the draw plate over the shackled mandrel which distends the blank from the inside outwardly. If the same draw plate is to be used for the distending and for the drawing step, it must have an inlet on two opposite sides.

Due to the initial widening or distending of an end of the tubular blank as taught by the invention by means of a shackled mandrel, a substantially more advantageous ratio of diameter to wall thickness is achieved for the subsequent application of the cascading or tandem drawing. The widening that increases the diameter simultaneously, achieves a relatively small wall thickness reduction. The subsequent stretching of the widened or distended section by a respective draw plate results in a wall thickness reduction which normally is sufficient for the subsequent tandem drawing.

After the stretching, the distended end of the tubular blank is inserted into a draw plate with the shackled mandrel inside the tubular blank. The draw plate has a draw hole with an inner diameter fitting exactly to the outer diameter of the stretched out blank end. It is not necessary to use a second draw plate, although that may be advantageous. As mentioned above, the draw plate that has been used for the stretching can also be used for this purpose provided the draw plate has two inlets on two opposite sides. After the stretching, the tubular blank is continuously drawn, whereby the shackled mandrel which is fixed in its axial position in the zone of the draw plate, widens the tubular blank while simultaneously reducing the wall thickness of the tubular blank in the draw plate zone in accordance with the dimensions of the draw hole in the draw plate and the dimensions of the shackled mandrel. If the wall thickness reduction that is achieved in such a first diameter widening or distending draw should be insufficient, then it is possible to apply a second, or even several more distending drawing operations. In each of these distending drawing operations the inner diameter of the drawing hole and the outer diameter of the shackled mandrel are stepwise increased so that the wall thickness of the tubular blank is further and further reduced.

According to another embodiment of the invention the blank end to be widened or distended is first inserted from the backside through the hole in the draw plate for the stretching, whereupon prior to the stretching a distention or widening is made with a fixed pin or shackled mandrel having an outer diameter suitable for the stretching. This modification of the invention has the further advantage that it does not require the insertion of an already distended end of the blank into the draw plate for the stretching.

According to a still further embodiment of the invention a draw grip is formed prior to the drawing operation, in the already distended section of the blank. It is easier to pass the draw grip through the hole in the draw plate since the diameter of the draw grip is smaller than the diameter of the draw hole in the draw plate. The draw grip extends out of the draw plate and can thus be gripped by a drawing or pulling tool. In this manner it is possible to prepare even tubular blanks having a diameter, outside the draw grip, larger than the inner diameter of the draw hole of the draw plate. Such an operation results in an efficient wall thickness reduction. However, the draw grip is waste material and must later be severed when the drawing operation has been completed.

According to yet another embodiment of the invention, the tubular blank is inserted through the draw hole of the draw plate, whereby the draw hole has a diameter larger than the outer diameter of the tubular blank. The protruding end of the bank is then gripped by drawing jaws having a gripping dimension conforming to the diameter of the draw hole, whereupon a shackled mandrel is pulled back from the other end of the tubular blank until the shackled mandrel is positioned within the area of the hole in the draw plate, whereby a distention and a simultaneous wall thickness reduction is achieved. Thereafter, the shackled mandrel is held in its position within the draw hole of the draw plate and the drawing operation is continued by a respective operation of the drawing jaws. In this manner it also becomes possible to achieve simultaneously with the widening of the blank a substantial reduction of the wall thickness of the blank. Another advantage of this modification is seen in that the stretching of a previously distended blank end is obviated. Further, a special draw plate for performing the stretching operation on an already widened blank end is also not necessary.

According to still another embodiment of the invention, one end of the blank is first widened with a shackled mandrel, whereupon a draw grip is formed in the widened zone or section. The so formed draw grip is then inserted with the draw grip facing in the forward direction through the draw hole in the draw plate while a mandrel is inside the blank, whereupon the drawing operation is performed. In this embodiment also the above objectives are achieved and simultaneously a separate stretching step over a portion or section of the blank is avoided. However, here again the draw grip is waste material which must be severed. However, this modification of the present teaching makes it possible that the drawing operation can be performed with a flying mandrel, whereby the draw plate and the mandrel must have a configuration and dimension suitable for the present purposes. More specifically, the initially shackled mandrel must be unshackled or released from its shackle during the drawing operation so that the mandrel can function as a flying mandrel during the drawing operation. More over, the respective draw hole in the draw plate must have a correspondingly small draw hole diameter so that the flying mandrel cannot pass through the draw hole. The unshackling of the initially shackled mandrel so that it may now work as a flying mandrel is easily accomplished in that the mandrel rod which was initially used for inserting the mandrel into the tubular blank is released from its mounting so that the mandrel rod can be axially displaced. This teaching of the invention makes it possible to simultaneously distend the blank while also reducing its wall thickness due to the inner widening during the stretching operation. Further, in this embodiment of the present method the previously distended or widened outer diameter of the tubular blank is again reduced to the desired smaller diameter due to the use of a draw hole with a smaller diameter.

BRIEF DESCRIPTION OF THE DRAWINGS

In order that the invention may be clearly understood, it will now be described, by way of example, with reference to the accompanying drawings, wherein:

FIGS. 1A to 1E illustrates one embodiment of the present method for preparing a tubular blank for the subsequent drawing operation, whereby the preparation includes forming a draw grip;

FIGS. 3A to 3D show a preparation of a tubular blank as in FIG. 1, however without the formation of a drawing grip;

FIGS. 5A to 5C illustrate the use of a double coned mandrel for the blank preparation, whereby the initially distended free end of the blank is then narrowed down again to form a draw grip;

FIG. 6A shows the beginning of a drawing operation by first distending the inner diameter of the blank followed by a reduction of at least the outer diameter;

FIG. 6B shows the beginning of the drawing operation with the aid of pulling or drawing tongs;

FIG. 6C shows a continuing drawing operation with the aid of applied drawing jaws.

Figure 2A:
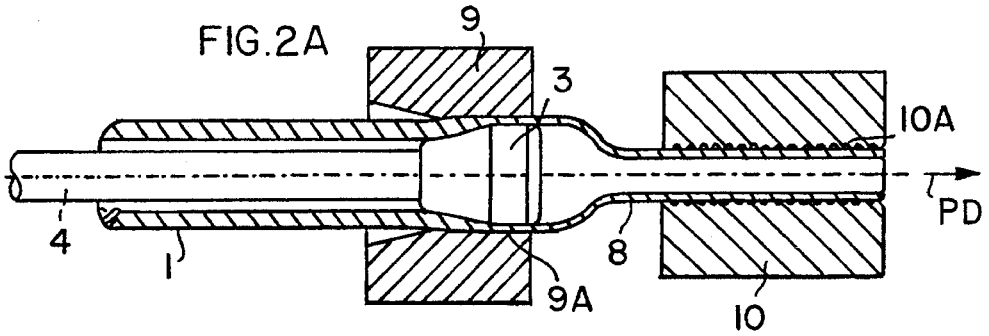
FIGS. 2A and 2B show the beginning of a drawing operation with drawing or pulling tongs clamping the blank end, and the continuous drawing operation, respectively, however drawing jaws are used instead of the tongs.

DETAILED DESCRIPTION OF PREFERRED EXAMPLE EMBODIMENTS AND OF THE BEST MODE OF THE INVENTION

FIG. 1A shows a blank 1 having a free end 1A protruding from the inlet I of a draw plate 2 having an inlet side 2A, a back side 2B and a draw hole 2C. The left or far end of the blank 1 is shown broken off. The free end 1A of the blank 1 is preferably inserted from the back side 2B in the direction of the arrow 1B, whereby the diameter of the draw hole 2C is not too critical. Preferably, the diameter of the draw hole 2C in the draw plate 2 is somewhat larger than the outer diameter of the free end 1A of the blank 1 so that it may be easily inserted as shown in FIG. 1A. It is acceptable that the inwardly facing surface of the hole 2C does not initially contact the outer surface of the blank 1 when the latter is concentrically positioned in the hole 2C. Next, a shackle rod 4 carrying a mandrel head 3 is inserted into the free end of the blank 1 as indicated by the arrow 4A. The left-hand end of the shackle rod 4 is shown broken off but it is shackled by a conventional shackling device not shown. The shackling device may comprise, for example, a clamp which grips the left end of the rod 4 and is capable of pulling the rod with its mandrel head to the left as indicated by the arrow 4A. The mandrel head 3 has a conical section 5 and a cylindrical section 6. It is, however, also possible to first insert the shackle rod 4 carrying the mandrel head 3 into the blank 1 and to then pass both components through the draw hole 2C of the draw plate 2 as indicated by the arrow 1B.

FIG. 1B shows the pulling of the shackle rod 4 in the direction of the arrow 4A for distending a section 7 of the free end 1A to an outer diameter 7A by the movement of the mandrel head 3 into the free end 1A of the blank 1. FIG. 1C shows that the distending movement of the mandrel head 3 is substantially completed and that the formation of a stretched section 12 begins. This formation is completed in FIG. 1D. A draw grip 8 may optionally be formed of at least part of the stretched out section 12 as shown in FIG. 1E.

Figure 2B:
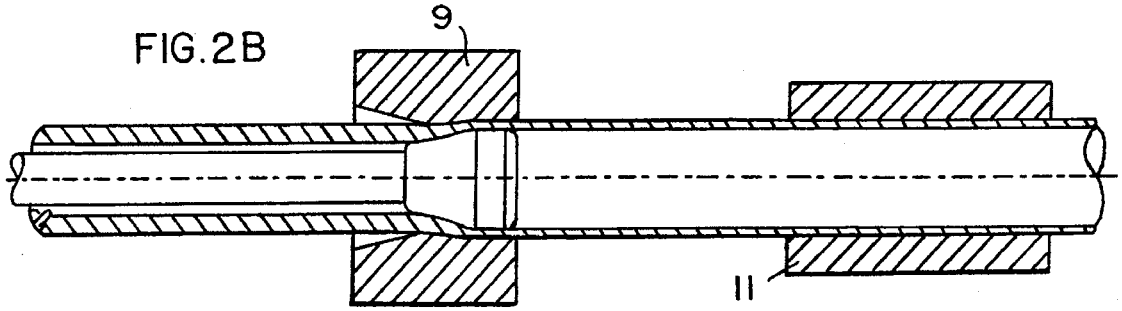

FIG. 2A shows the beginning of a drawing operation in which the shackle rod 4 holds the shackled mandrel head 3 in a fixed position in a hole 9A of a further draw plate 9 with the draw grip 8 held fast by drawing or pulling tongs 10 provided with friction increasing teeth 10A for pulling the blank 1 in the pulling or drawing direction PD. FIG. 2B shows the progression of the pulling operation, however illustrating the use of drawing jaws 11 instead of the tongs 10, whereby the end that is being pulled does not need to be provided with a draw grip 8 as in FIG. 2A.

FIGS. 3A, 3B, 3C and 3D illustrate a similar sequence of operational steps as FIGS. 1A to 1D. The grip formation of FIG. 1E is omitted in the sequence of FIGS. 3A to 3D. In FIG. 3A, as in FIG. 1A, the left-hand end 1C of the tubular blank 1 is held in a fixed position and the mandrel head 3 is then pulled to the left into the free end 1A to widen the latter and form the distended section 7 as shown in FIG. 3B. For this purpose the shackle rod 4 of the mandrel head 3 is pulled to the left as indicated by the arrow 4A. The conical section 5 of the mandrel head 3 widens the inner diameter of the right-hand end 1A of the tubular blank until the diameter of the cylindrical section 6 of the mandrel head 3 is reached. The movement of the mandrel 3 pulled by its shackle rod 4 to the left is continued until the mandrel head 3 assumes the position in the draw hole 2C of the draw plate 2 shown in FIG. 3C. This relative position between the mandrel head 3 and the draw plate 2 to each other is maintained during the further preparatory treatment of the blank 1 which is held in a fixed position by clamps not shown if the plate 2 and head 3 are moved as indicated by the arrow 1B in FIG. 3C. More specifically, the mandrel head 3 with its rod 4 and the draw plate 2 are now moved to the right with the blank 1 held fixed. This relative position between mandrel and draw plate is maintained until the right-hand free end of the blank 1 is reached. As a result, the stretched section 12 shown in FIG. 3D has been formed. The stretched out section 12 has an outer diameter that is larger than the outer diameter of the blank 1. The inner diameter of the section 12 is also increased compared to the blanks so that the wall thickness of the stretched out section 12 is distinctly smaller than the wall thickness of the blank 1. Instead of moving plate 2 and head 3 these elements could be locked in position and the blank 1 moved to the left instead.

Figure 4:
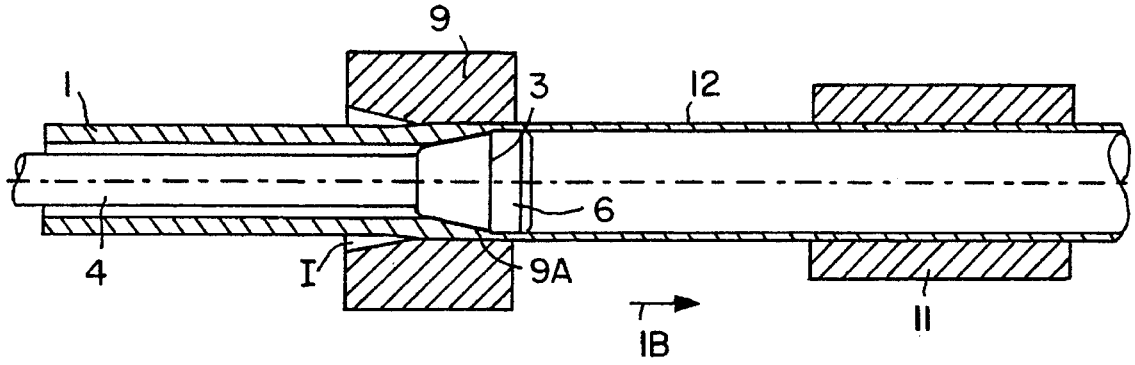
FIG. 4 illustrates a continuous drawing operation which can, however, also be performed with drawing jaws directly engaging the blank end without the formation of a drawing grip.

FIG. 4 shows the continuing drawing operation with the aid of drawing jaws 11 that grip the stretched section 12 without any draw grip 8. Before the drawing jaws 11 grip the stretched section 12, the latter is inserted through the inlet I of a draw plate 9 which is basically the same as the draw plate 2 except that the inlet I is on the left facing side rather than on the right facing side. The draw plate 9 has a draw hole 9A with a diameter corresponding exactly to the outer diameter of the stretched section 12. Thus, section 12 can be passed through the hole 9A. The mandrel head 3 is assuming a position such that its cylindrical section 6 is within the cylindrical section of the hole 9A in the draw plate 9 similar to the position shown in FIG. 3. The die plate 9 and the mandrel head 3 with its shackle rod 4 are now maintained in a fixed position and the draw jaws 11 that have gripped the stretched section 12 pull the blank 1 to the right in the direction of the arrow 1B after the blank 1 has been released from the above mentioned clamps that kept the blank 1 stationary during the steps illustrated in FIGS. 3A to 3D. This drawing operation increases the outer and inner diameter of the drawn section compared to the respective diameter of the blank, whereby the wall thickness of the drawn or stretched section 12 is also reduced as shown in FIG. 4. FIG. 4 is substantially similar to FIG. 2B, however FIG. 4 is supposed to illustrate the continuing drawing operation while FIG. 2B shows the beginning of a continuous drawing operation.

FIGS. 5A, 5B, 5C and FIGS. 6A, 6B, 6C illustrate a modified operation according to the invention using a mandrel head 13 with two oppositely facing conical sections 14 and 16 spaced from each other by a cylindrical section 15. FIG. 5A shows the tubular blank 1 into which the shackle rod 4 of the mandrel head 13 has been inserted as indicated by arrow 4A. The conical sections 14 and 16 face each other with their large diameter ends spaced by the cylindrical section 15.

FIG. 5B shows that the mandrel head 14 has been pulled into the blank end 1A by pulling the shackle rod 4 to the left in the direction of the arrow 4A. When the mandrel head 13 is pulled into the free end 1A of the blank 1, the blank 1 is kept stationary, whereby the conical section 14 widens the inner diameter of the blank up to the diameter of the cylindrical section 15. The outer blank diameter is also simultaneously widened along the widened length 17 as shown in FIG. 5B. The wall thickness is slightly reduced in this widened section 17. The widened section 17 can now be formed into a draw grip 18 shown in FIG. 5C by the cooperation of the conical mandrel section 16 and a draw plate suitable for this purpose, in preparation of the further drawing operation.

FIG. 6A illustrates one possibility of further preparing the blank after the draw grip 18 has been formed as shown in FIG. 5C. The grip 18 is inserted into a draw plate 19 having a draw hole 19A with a hole diameter smaller, preferably substantially smaller, than the outer diameter of the cylindrical section 15 of the mandrel head 13. The drawing can now proceed with the mandrel 13 used as a flying pin or flying mandrel. For this purpose the shackle rod 4 is released from its clamping device not shown and then the blank 1 is pulled to the right as shown by arrow 1B in FIG. 6A. The dimensions of the draw hole 19A and of the mandrel 13 are so selected that a flying mandrel drawing operation can be performed to keep the flying mandrel from slipping through hole 19A. After the widening, the draw plate 19 stretches the blank while simultaneously reducing the outer diameter of the blank. Depending on the dimensional relationships of the hole diameter and the mandrel diameter relative to each other a very efficient operation is achieved because the reduction of the outer diameter of the blank is intended anyway so that this operation is already in the direction of the outer diameter reduction intended by the tandem drawing operation to follow the above described preparation of the blank.

FIG. 6B shows a further modification. Once the grip 18 has been formed, the mandrel 13 and the blank 1 are inserted into a hole 20A of a draw plate 20. The hole 20A has a diameter sufficient for the outer diameter of the respective blank portion to fit through the hole. In FIG. 6B the draw grip 18 is gripped by tongs 10 provided with friction enhancing gripper teeth 10A and pulled to the right with the mandrel 13 shackled to form the prepared blank with the desired wall thickness W. The grip 18 is lost material that must be cut off.

FIG. 6C shows a modification wherein the drawing is performed by drawing jaws 11 without a draw grip 18. In both instances, in FIG. 6B and in FIG. 6C the cylindrical portion 15 of the mandrel head 13 is maintained substantially within the hole 20A of the draw plate 20. The outer diameter of the blank must be such that it fits precisely into the hole 20A. This is accomplished by a stretching operation as described above, for example with reference to FIG. 1C. Stated differently, the widened section 17 of FIG. 5B is stretched and the stretched section is inserted into the draw plate 20 for gripping by the drawing jaws 11. The resulting prepared blank 1D is suitable for the following tandem drawing. The operation according to FIG. 6C may be preferred, especially when the tubular material is expensive, to avoid wasting the grip 18.

Figure 7A:
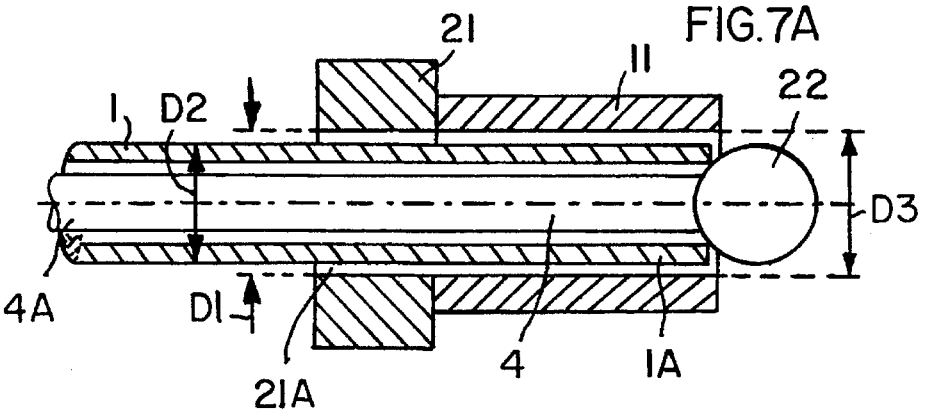
FIGS. 7A to 7C show respectively the preparation, the beginning, and the performance of the drawing operation starting with a tubular blank, whereby drawing jaws are used and the mandrel has a spherical end.
Figure 7B:
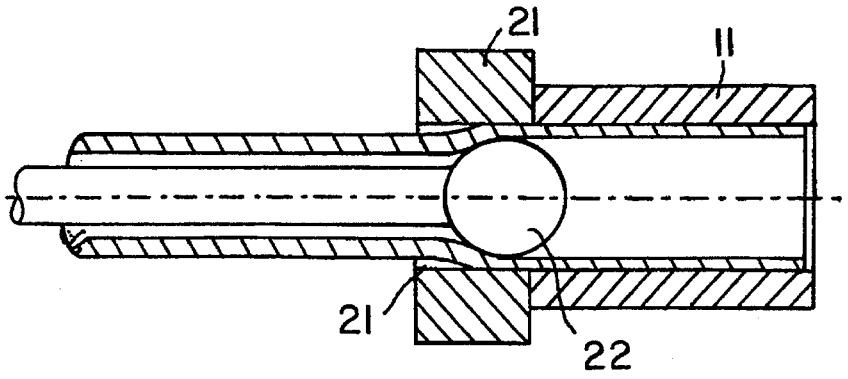
Figure 7C:
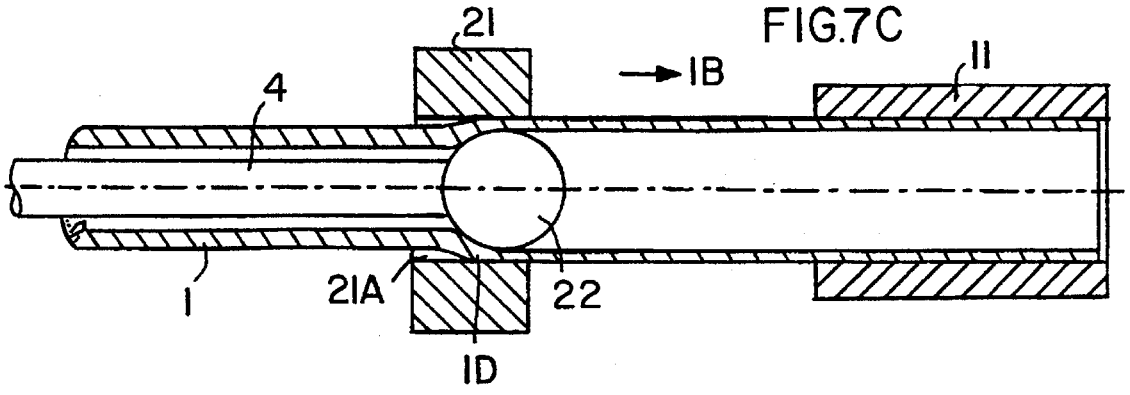

FIGS. 7A, 7B and 7C illustrate another modification of the present preparation method for tubular blanks. A tubular blank 1 is inserted into a draw plate 21 having a hole 21 with a hole diameter D1 larger than the outer diameter D2 of the blank 1. The drawing jaws 11 have a gripping diameter D3 corresponding to the hole diameter D1. The gripping jaws 11 are operated by a conventional slide drawing machine not shown. A spherical mandrel head 22 connected to the shackle rod 4 is pulled into the free end 1A of the blank 1 to widen the outer diameter and the inner diameter of the blank end 1A as shown in FIG. 7B, wherein the mandrel head 22 is positioned substantially within the hole 21A of the draw plate 21. Now the mandrel head 22 is shackled in the position shown in FIG. 7B by clamping the rod 4 and the gripper jaws 11 pull the blank in the direction of the arrow 1B to the right as shown in FIG. 7C.

In this embodiment, illustrated in FIG. 7C, it is possible to move the blank with the drawing jaws 11 in the direction of the arrow 1B while simultaneously moving the draw plate 21 in the opposite direction in synchronism with the right-hand movement to keep the spherical mandrel head 22 in the draw hole 21A. The material flow at 1D in FIG. 7C is controlled by the diameter of the spherical mandrel 22 and the hole diameter of the hole 21A and by the pulling speed or the relative speeds of the components involved in the diameter widening and wall thickness reduction. Since the draw plate 21 does not have a special inlet it is possible to perform the relative movement in one or the other directions, however depending on which of the free blank ends is initially widened as shown in FIG. 7A.

In any of these possibilities of FIGS. 7A to 7C a substantial widening combined with a wall thickness reduction are achieved simultaneously. A stretching step as described in connection with the other embodiments is not necessary in the sequence of FIGS. 7A, 7B and 7C. As a result, a respective further drawing plate can also be obviated.

Although the invention has been described with reference to specific example embodiments, it will be appreciated that it is intended to cover all modifications and equivalents within the scope of the appended claims.

What is claimed is:

1. A method for reducing an initial wall thickness of a tubular blank (1) which thickness is too thick for a cascade or tandem drawing, to a reduced wall thickness that is sufficiently thin for said cascade or tandem drawing, comprising:

(a) radially distending one end (1A) of said tubular blank with a shackled or controllable mandrel (3) by pulling said mandrel through said one end (1A) of said tubular blank to form a distended section (7) next to said one end to provide a first wall thickness reduction, (b) axially stretching said distended section (7) by a cooperative action between said shackled or controlled mandrel (3) and a draw plate (2) to impose an external stretching action on said tubular blank (1) by said draw plate for forming a stretched section (12) next to and along said one end to provide a second wall thickness reduction, (c) passing said stretched section (12) through said draw plate with said stretched section (12) protruding from said draw plate in a drawing direction (PD), and (d) drawing said tubular blank in said drawing direction (PD) through said draw plate over said shackled or controlled mandrel (3) which thereby distends said tubular blank (1) from the inside of said tubular blank (1) to provide said wall thickness that is sufficiently thin for said cascade or tandem drawing.

2. The method of claim 1, further comprising:

(a) passing said one end (1A) of said tubular blank (1) through said draw plate from the rear of said draw plate, and then (b) performing said distending step prior to said drawing step for distending or widening said first end (1A) with said shackled or controlled mandrel, to a widened outer diameter suitable for stretching.

3. The method of claim 1, further comprising forming, prior to said drawing step, a draw grip along at least part of said distended section (7) for gripping by a tool.

4. The method of claim 1, wherein said tubular blank is cast prior to said distending.

5. The method of claim 1, wherein said tubular blank is formed by pressing or extruding prior to said distending.

6. The method of claim 1, wherein said following drawing operation is performed as a cascade drawing or tandem drawing operation.

7. The method of claim 1, wherein said draw plate is a single draw plate having two inlets, one inlet being positioned on one side, the other inlet being positioned on an opposite side of said single draw plate.

8. The method of claim 1, wherein said draw plate comprises two separate draw plates each having one inlet.

9. A method for reducing an initial wall thickness of a tubular blank (1) to a wall thickness suitable for a following drawing operation, comprising:

(a) passing one end (1A) of said tubular blank (1) through a draw plate (21) having a draw hole (21A) with a diameter (D1) larger than an outer diameter (D2) of said tubular blank, (b) inserting said one end (1A) of said tubular blank (1) into drawing jaws (11) having a gripping dimension (D3) corresponding to said hole diameter (D1), (c) partly pulling a shackled or controllable mandrel (22) in a first direction into said one end (1A) of said tubular blank (1) toward said draw plate (21) into a position substantially in said hole (21A) of said draw plate (21) to form said one end (1A) into a lead end, (d) gripping said lead end of said tubular blank (1) by said drawing jaws, and (e) drawing said tubular blank (1) by said drawing jaws (11) in a direction opposite to said first direction while said mandrel (22) is held in a fixed position in said hole (21A) for distending said tubular blank while simultaneously reducing its wall thickness.

10. The method of claim 9, wherein said tubular blank is a cast tubular member.

11. The method of claim 9, wherein said tubular blank is a pressed or extruded tubular member.

12. The method of claim 9, wherein said following drawing operation is performed as a cascade drawing or tandem drawing operation.

13. A method for reducing an initial wall thickness of a tubular blank (1) to a wall thickness suitable for a following drawing operation, comprising:

(a) distending one end of said tubular blank with an initially shackled or controllable mandrel to form a distended section (7), (b) forming a draw grip at least along part of said distended section for gripping by a tool, (c) passing said draw grip through a draw plate with said initially shackled mandrel inserted in said tubular blank (1), (d) unshackling said initially shackled or controllable mandrel, and (e) drawing said tubular blank by pulling said draw grip while said mandrel is unshackled to perform as a flying pin mandrel.

14. The method of claim 13, wherein said draw plate and said flying pin mandrel have a suitable shape and dimensions for said drawing.

15. The method of claim 13, wherein said tubular blank is a cast tubular member.

16. The method of claim 13, wherein said tubular blank is a pressed or extruded tubular member.

17. The method of claim 13, wherein said following drawing operation is performed as a cascade drawing or tandem drawing operation.

* * * * *